US009016308B2

(12) United States Patent
Docheff

(10) Patent No.: US 9,016,308 B2
(45) Date of Patent: Apr. 28, 2015

(54) PORTABLE AXILLARY FUEL SUPPLY

(76) Inventor: Frank Docheff, Kremmling, CO (US)

( * ) Notice: Subject to any disclaimer, the term of this patent is extended or adjusted under 35 U.S.C. 154(b) by 656 days.

(21) Appl. No.: 13/168,542

(22) Filed: Jun. 24, 2011

(65) Prior Publication Data

US 2012/0325355 A1 Dec. 27, 2012

Related U.S. Application Data

(60) Provisional application No. 61/398,478, filed on Jun. 24, 2010.

(51) Int. Cl.

| | |
|---|---|
| ***F02M 37/08*** | (2006.01) |
| *F02N 11/12* | (2006.01) |
| *B67D 7/04* | (2010.01) |
| *B67D 7/84* | (2010.01) |
| *F02M 37/16* | (2006.01) |

(52) U.S. Cl.

CPC ..... *F02M 37/08* (2013.01); *F02N 11/12* (2013.01); *B67D 7/04* (2013.01); *B67D 7/84* (2013.01); *F02M 37/16* (2013.01)

(58) Field of Classification Search

USPC ..... 137/351, 899, 354, 355; 222/610, 180, 222/333, 377, 23; 123/445, 198 D; 454/128, 454/135

See application file for complete search history.

(56) References Cited

U.S. PATENT DOCUMENTS

| | | | | |
|---|---|---|---|---|
| 2,501,273 | A * | 3/1950 | Goetz | 454/128 |
| 3,904,116 | A * | 9/1975 | Jones et al. | 239/127 |
| 4,595,841 | A * | 6/1986 | Yaguchi | 290/1 A |
| 6,305,357 | B1 * | 10/2001 | Soukeras | 123/495 |
| 7,108,026 | B2 | 9/2006 | Luca | |
| 7,293,587 | B1 * | 11/2007 | Broberg | 141/389 |
| 7,472,849 | B2 * | 1/2009 | Cusano | 239/650 |
| 7,811,159 | B2 * | 10/2010 | Wilson et al. | 454/119 |
| 8,181,667 | B2 * | 5/2012 | Ford | 137/255 |
| 8,662,044 | B2 * | 3/2014 | Becker et al. | 123/179.3 |
| 2005/0082833 | A1 * | 4/2005 | Sodemann et al. | 290/1 A |
| 2009/0236434 | A1 * | 9/2009 | Hohensee | 237/12.3 A |

* cited by examiner

*Primary Examiner* — Craig Schneider
*Assistant Examiner* — Ian Paquette
(74) *Attorney, Agent, or Firm* — Patent Law Offices of Rick Martin, P.C.

(57) ABSTRACT

A portable DC powered fuel pump is encased in a housing that can mount adjacent the driver's window to provide fuel to an engine with a broken fuel pump. Several mounting means are disclosed including a groove in the bottom of the housing and/or drop down legs for the door panel combined with an L bracket to grab the windowsill. Various fuel supplies are shown ranging from a fuel hose from the gas fill port to an external plastic tank to an internal tank in a vented housing. Options include lights, fuel pressure adjustment, power source options, a handle and a heat cushion for temporary use in an engine compartment.

6 Claims, 8 Drawing Sheets

PORTABLE AXILLARY FUEL SUPPLY

CROSS REFERENCE APPLICATIONS

This is a non-provisional application claiming priority to provisional patent application Ser. No. 61/398,478 filed Jun. 24, 2010.

FIELD OF INVENTION

The present invention relates to motor vehicle fuel system troubleshooting devices as well as the need for the repositioning of a fuel system disabled motor vehicle by bypassing its own fuel delivery system. By providing directly to an engine an external source of fuel at a selectable octane and pressure, complete fuel systems are effectively bypassed and, not only are vehicles startable and repositionable, conclusions can be made regarding status of vehicle fuel delivery systems.

BACKGROUND OF THE INVENTION

Since the invention of the internal combustion engine and its application to motorized forms of transportation, mechanics and do-it yourselfers have struggled with the repositioning of vehicles displaying fuel system delivery malfunctions. Frequently the reposition of disabled vehicles has resulted in both personal injury and/or property damage in that pushing or pulling a vehicle with limited means can cause wreckless navigation and difficulties with safe starting and stopping, usually into or around vehicle repair facilities. The present invention eliminates these issues by providing complete control of auxiliary fuel system from an operator seated in safe navigational control of the vehicle. With this invention a single operator can quickly install auxiliary fuel apparatus, start and drive the vehicle to a location that is either safe from oncoming traffic and/or safely move the vehicle into an enclosed repair environment. By its universal design it can be easily adapted to properly fit a wide variety of engines and types of vehicles ranging from golf cart type vehicles to large over the road gasoline powered trucks and transports. Additional, diagnostic type embodiments address other forms of internal combustion engine fitted machines from lawn mowers or snowblowers to snowmobiles, boats and motorcycles.

Numerous fuel system diagnostic devices have been invented but to this point in time, no portable, vehicle mount, self contained auxiliary fuel systems with universal adaptation have been patented.

The closet known art is U.S. Pat. No. 7,108,026 (2006) to Luca. Luca discloses a portable gasoline container that has an onboard electric fuel pump and either a battery or cables to connect to the vehicle battery. A fuel pressure regulator and pressure gauge are built into the container. The device is designed to place the container at or near the engine, turn it on, then enter the vehicle and drive it a short distance. Three major problems exist with the Luca device. First the container will melt if placed on a hot engine block. Second if a fire starts, then the driver has no way to turn the fuel pump off without subjecting himself to a burning engine. Third it is unknown how the driver can see with the hood up to accommodate the Luca device. If the hood is placed atop the Luca device a high risk of starting a fire in the engine compartment is created with a moving vehicle having an unseen gas container atop a hot engine. What is needed in the art is a housing that resists heat and a housing that provides driver access to an OFF switch in case of emergency. The present invention meets these needs.

The preferred embodiment of this invention is designed such that an operator can temporarily mount apparatus on a door of a disabled vehicle. He can quickly attach fuel and/or power attachments to vehicle. He can start and move the vehicle to a safe working environment and then quickly reposition apparatus into engine compartment area for diagnostic analysis. With conventional and redundant electrical and fuel safety standards, night illumination and all weather construction enables effective use of device in all forms of weather and in all quantities of light.

SUMMARY OF THE INVENTION

The main aspect of the present invention is to provide a portable fuel supply and pump that mounts to a driver's window ledge to provide an instant access to an "OFF" switch.

Another aspect of the present invention is to provide a heat resistant inner shell for the device to prevent a meltdown against a hot engine.

Another aspect of the present invention is to provide on onboard fan to dissipate fuel fumes and prevent an explosion.

Another aspect of the present invention is to provide console lighting and area lighting on the handle.

This invention delivers a portable and regulatable fuel supply directly to an engine for two fundamental objectives. First it supplies exactly the correct type and pressure of fuel directly to an engine, bypassing its fuel supply allowing the vehicle to be started and moved. Secondly it provides analysis and diagnostic information to repair personnel in troubleshooting a possible fuel system problem. This device also assists individuals who need to perform engine analysis in the acquisition of junkyard parts.

The list of diagnostic indicators that this device can assist with includes but is not limited to:

restricted fuel
fuel pump malfunction
fuel pump power supply failure
fuel tank contamination
fuel system air leak etc
Fuel System
Bib fill and drain trays
Large vent to monitor fill level
Gage-volume
Gage-Pressure
Adjustable pressure
low fuel alarm
Fire Suppression
Electrical Power System
power source selector switch
spark proof engineering/materials
illuminated volt meter (optional)
Emergency shut off
Auto shut off with alarm
Aux auto 12 vdc harness (cigarette lighter)
Useful Features
External light, clip on/magnetic
adjustable handle light
fold outdoor support panels
multiple light source Ground/engine compartment lighting
Gage lighting
Console lighting
Jet and fitting and fuse tray
bean bag engine cushion
Adjustable/self storing door or window mount brackets
Base release lever
fire extinguisher bracket emergency shut off fuel hose storage
Cigarette lighter fitted wiring harness
park proof/non conductive case
magnetic, scratch proof hose carriers
cabinet drain
powered ventilation Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
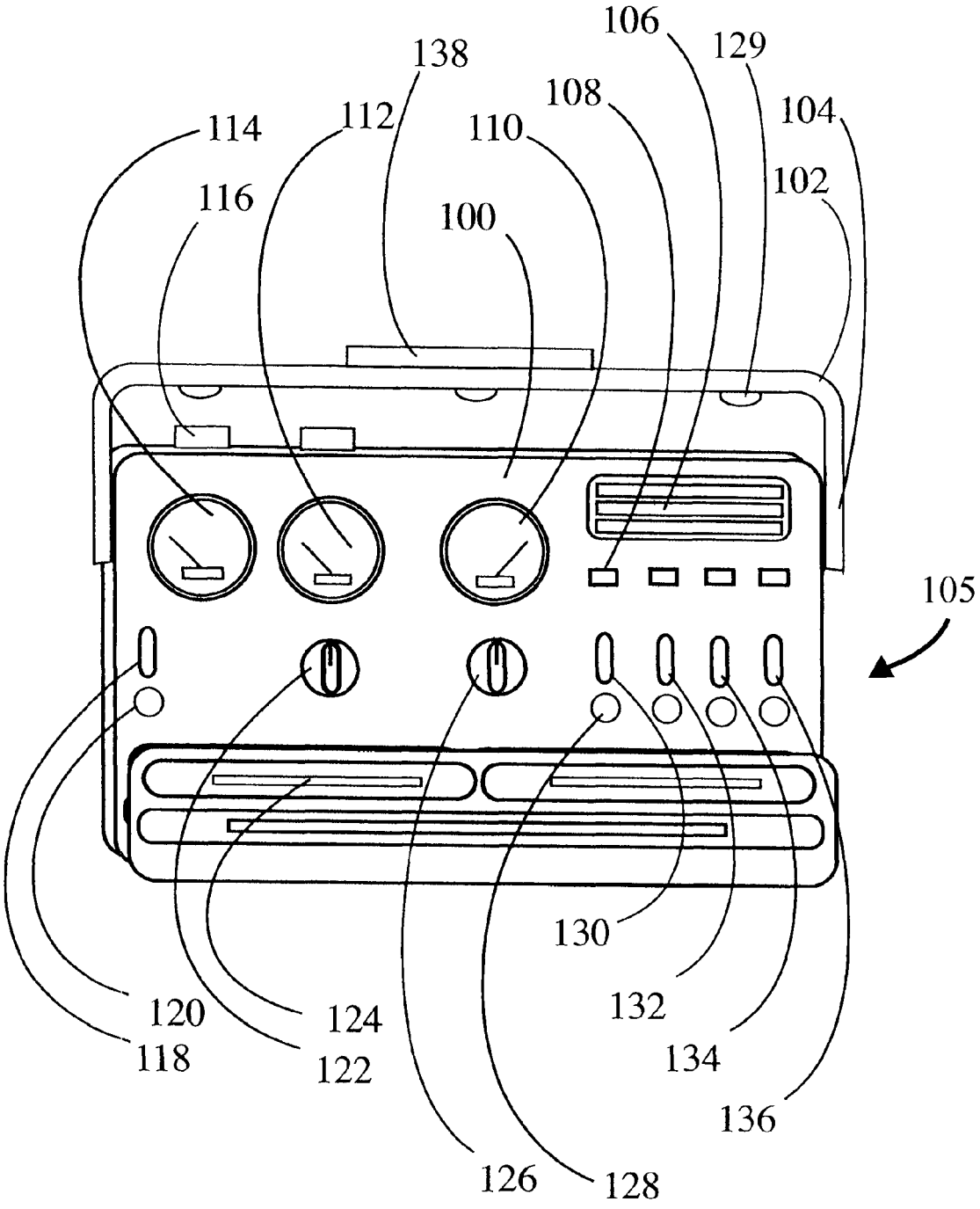
FIG. 1 is a front elevation view of the preferred embodiment.

Referring first to FIG. 1 the auxiliary fuel delivery device 105 has a carry handle 102. Console lights 129 shine onto the front of the housing 100. Remote lights 140 on the brackets 144 can light up the engine compartment 107 shown in FIG. 7. Fuel pump toggle on/off switch 136 is shown. Remote light switch 130, console light switch 132 and auxiliary fan switch 134 are shown to each have an "on" indicator light 108. The housing ventilation 106 vents the fan 158 exhaust air to prevent a gas fume explosion. The handle 102 has two pivots labeled 104.

The main power switch 118 controls all electric power to the device 105. The fuse 120 is used in series with main power switch 118.

Fuel pressure is adjusted by knob 122. A storage drawer 124 can hold fuel fittings for various make cars. The power source connection switch 126 allows the user to select vehicle battery 150 or an external source 148 or the onboard battery 156 of FIG. 3 for power. The fuel gauge 114 indicates the gasoline (or diesel) level in fuel cell 154 shown in FIG. 3. Fuel cell cap 116 allows filling with fuel. The output fuel pressure is shown by gauge 112. The input voltage is shown by gauge 110. An emergency SHUT OFF switch 138 is on the handle to cut all power to device 105.

Figure 2:
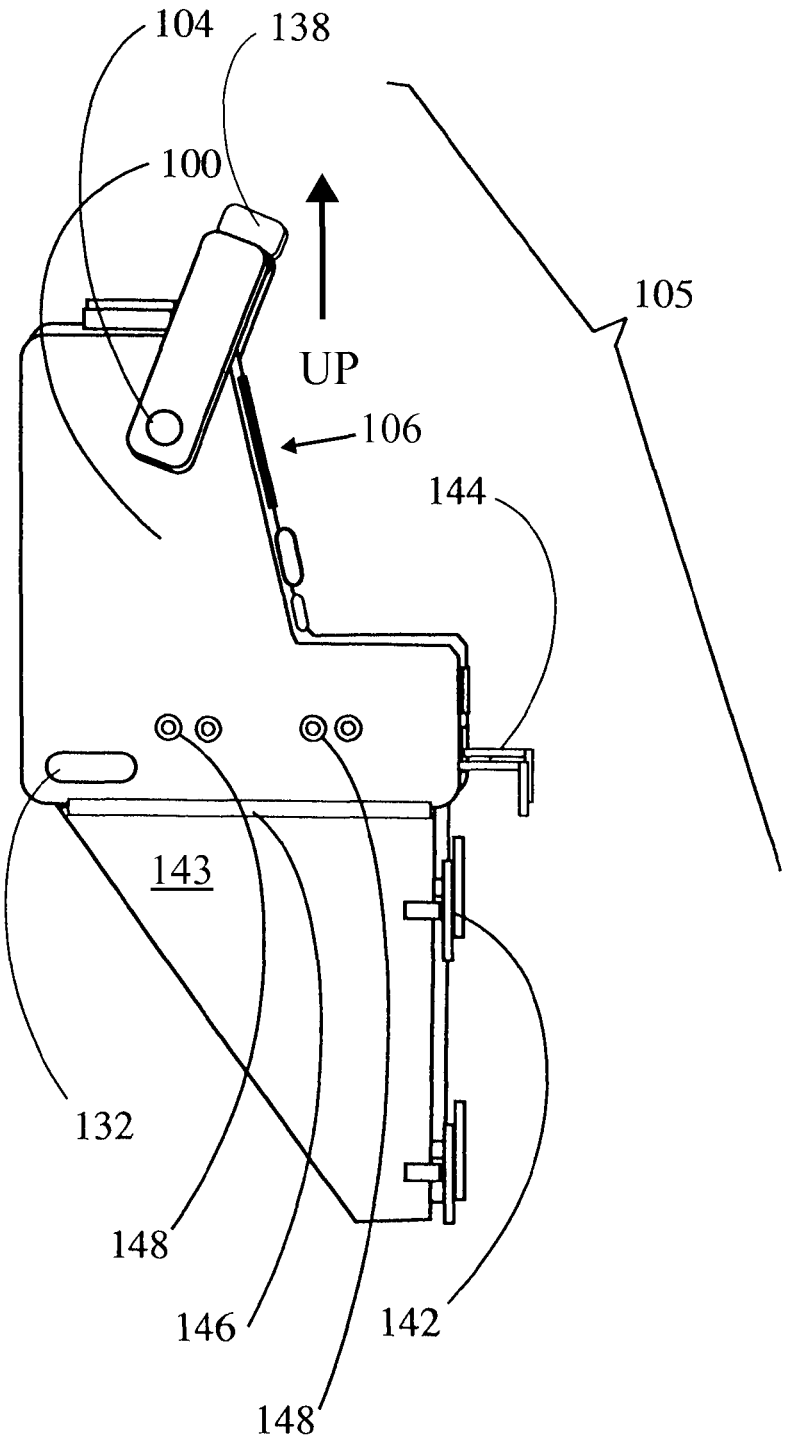
FIG. 2 is a side elevation view of the preferred embodiment.
Figure 5:
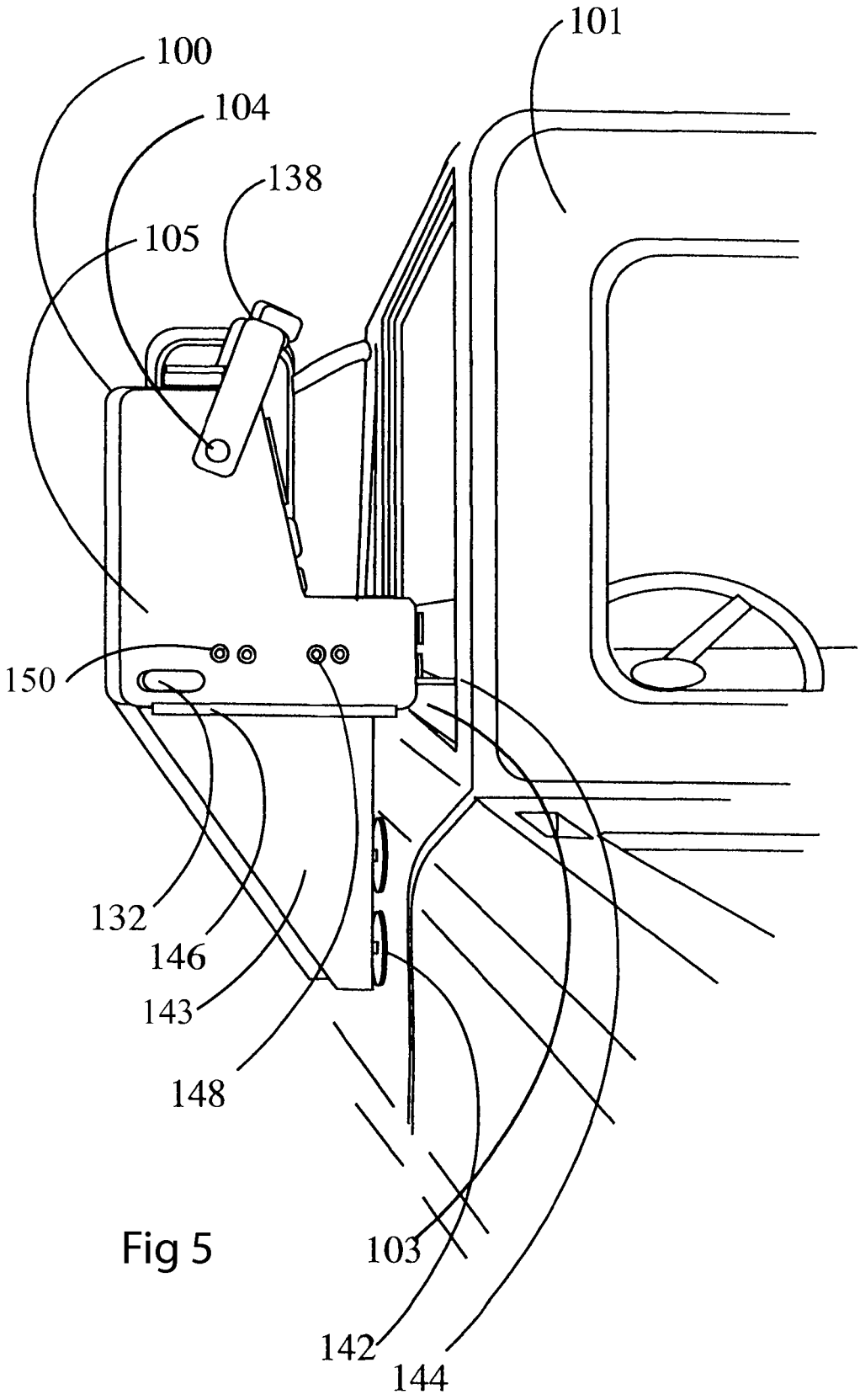
FIG. 5 is a side perspective view of the preferred embodiment installed on a vehicle door.

Referring next to FIG. 2 the device 105 is ready to mount on the driver's window 103 shown in FIG. 5. The retractable window brackets 144 have been pulled out. The lower braces 143 are deployed downward via hinges 146. The rubber cups 142 protect the car door. The housing 100 is now supported outside the driver's open window for total access. Arrow UP shows the tilted vents 106 which divert fumes (if any) away from the vehicle.

Figure 3:
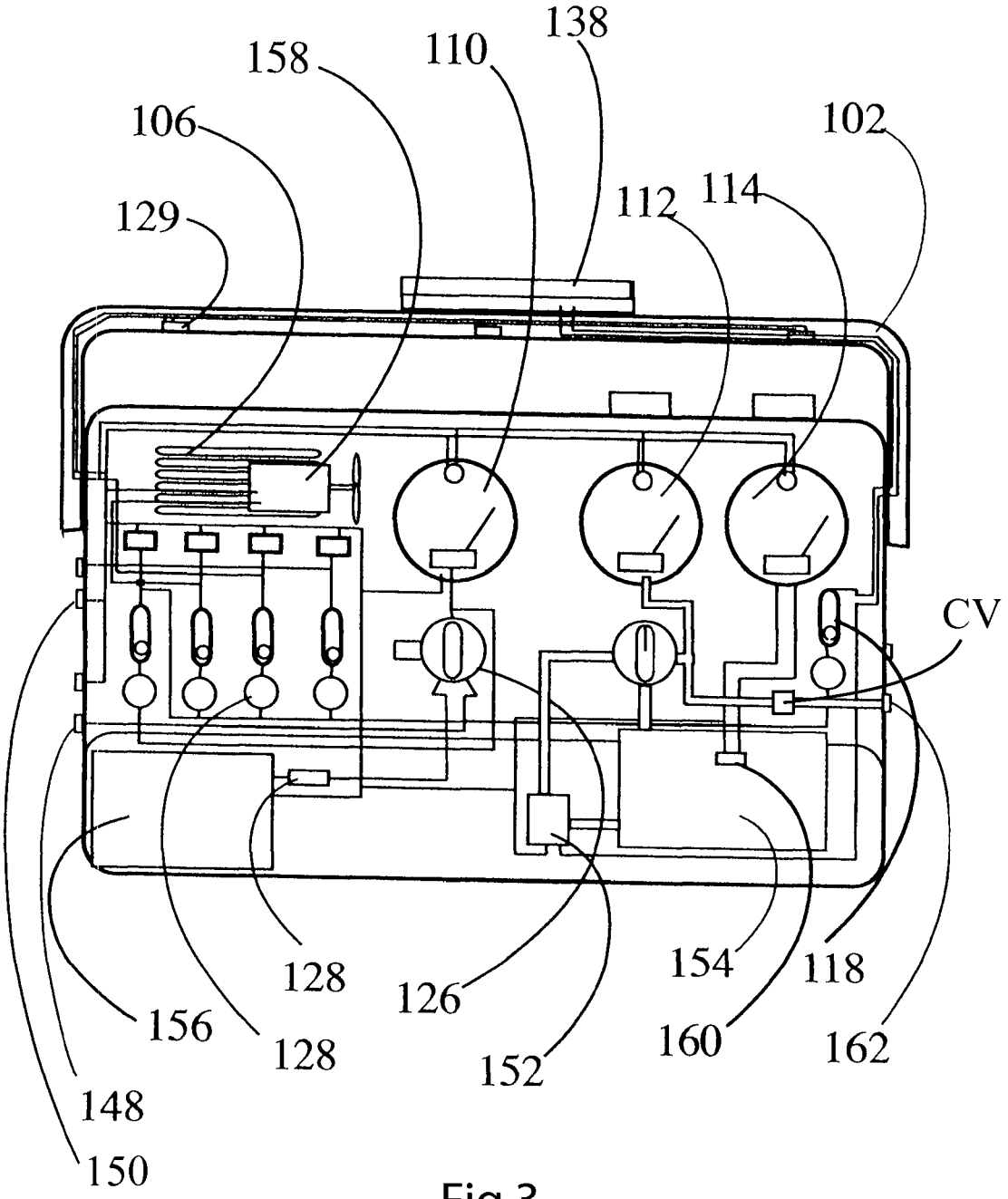
FIG. 3 is a schematic view of an opened rear view of the preferred embodiment.

In FIG. 3 the rear of housing 100 is removed to show the fuel cell 154, fuel pump 152 and level sensor 160. The fuel delivery outlet line 162 must be fitted with a vehicle compatible connector to feed the various fuel injection systems.

Figure 4:
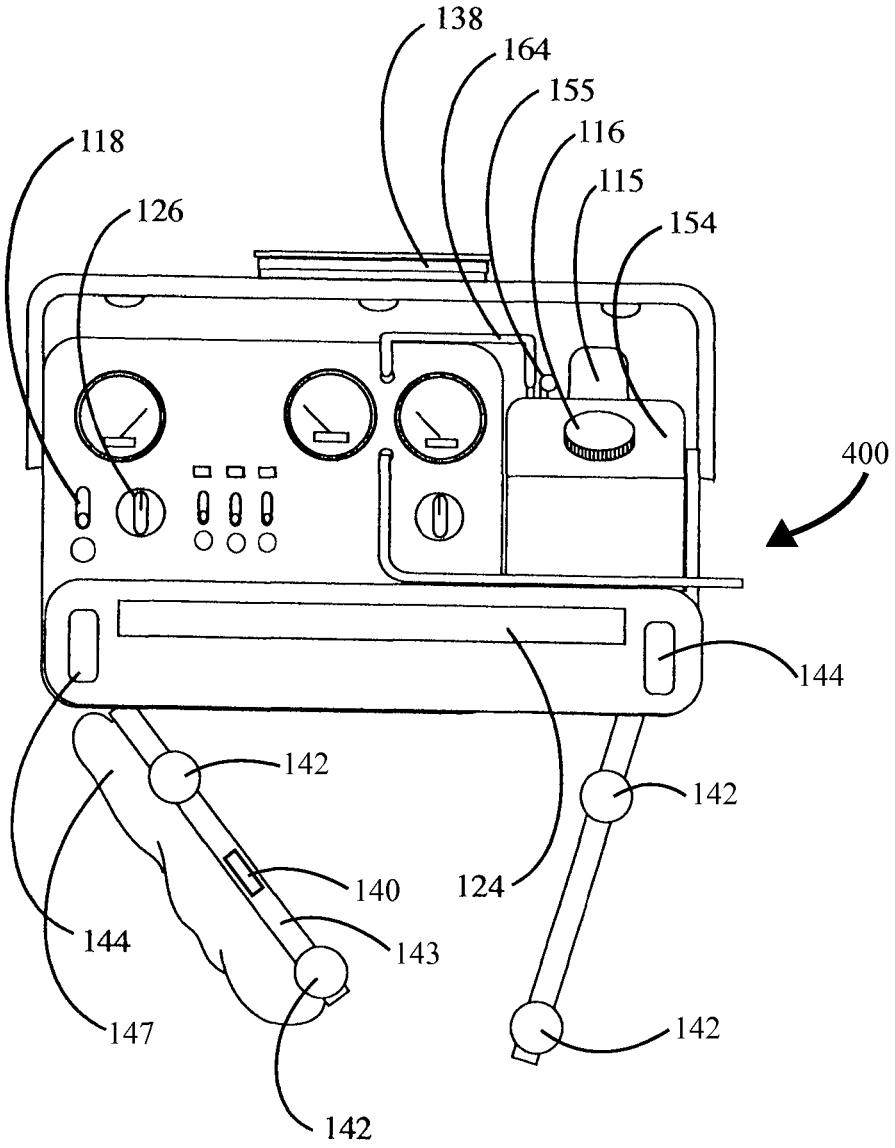
FIG. 4 is a front elevation view of an external fuel cell embodiment.
Figure 7:
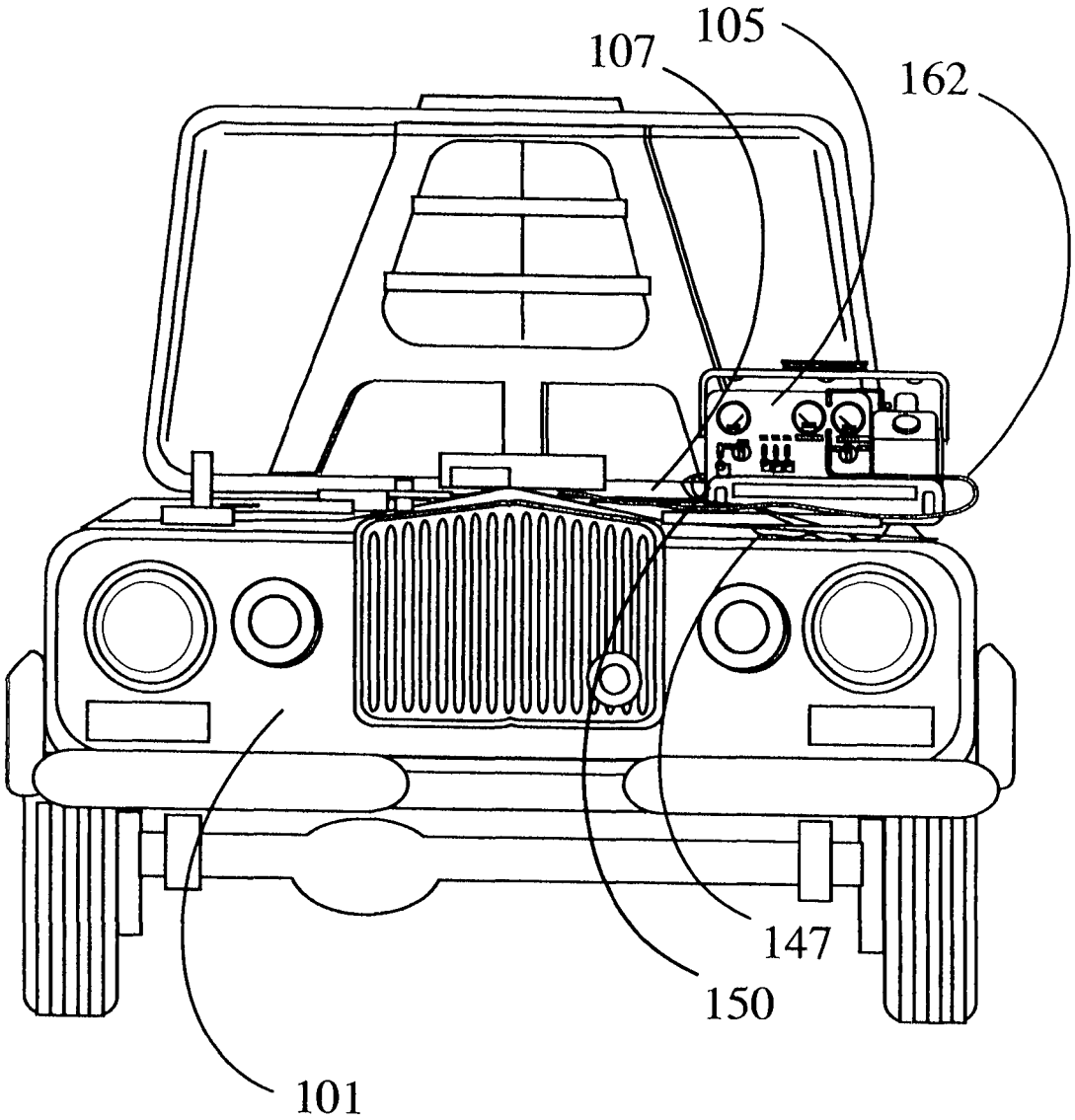
FIG. 7 is a front elevation view of the preferred embodiment installed within an engine compartment.

Referring next to FIG. 4 the external fuel cell device 400 functions the same as device 105 of FIG. 1. The hinged, padded mounting braces 143 are lowered for placement on a vertical door panel. When they are not lowered the heat resistant pad 147 allows placement in the engine compartment as shown in FIG. 7. The light 140 can light up the engine compartment 107. A fuel transfer line 164 connects the fuel pump 152 to the external fuel cell 1540.

Referring next to FIG. 5 the device 105 is shown ready for use mounted on the window 103 for access by the driver. The kill switch 138 is right on top. All of the embodiments in the present invention can mount this way.

Figure 6:
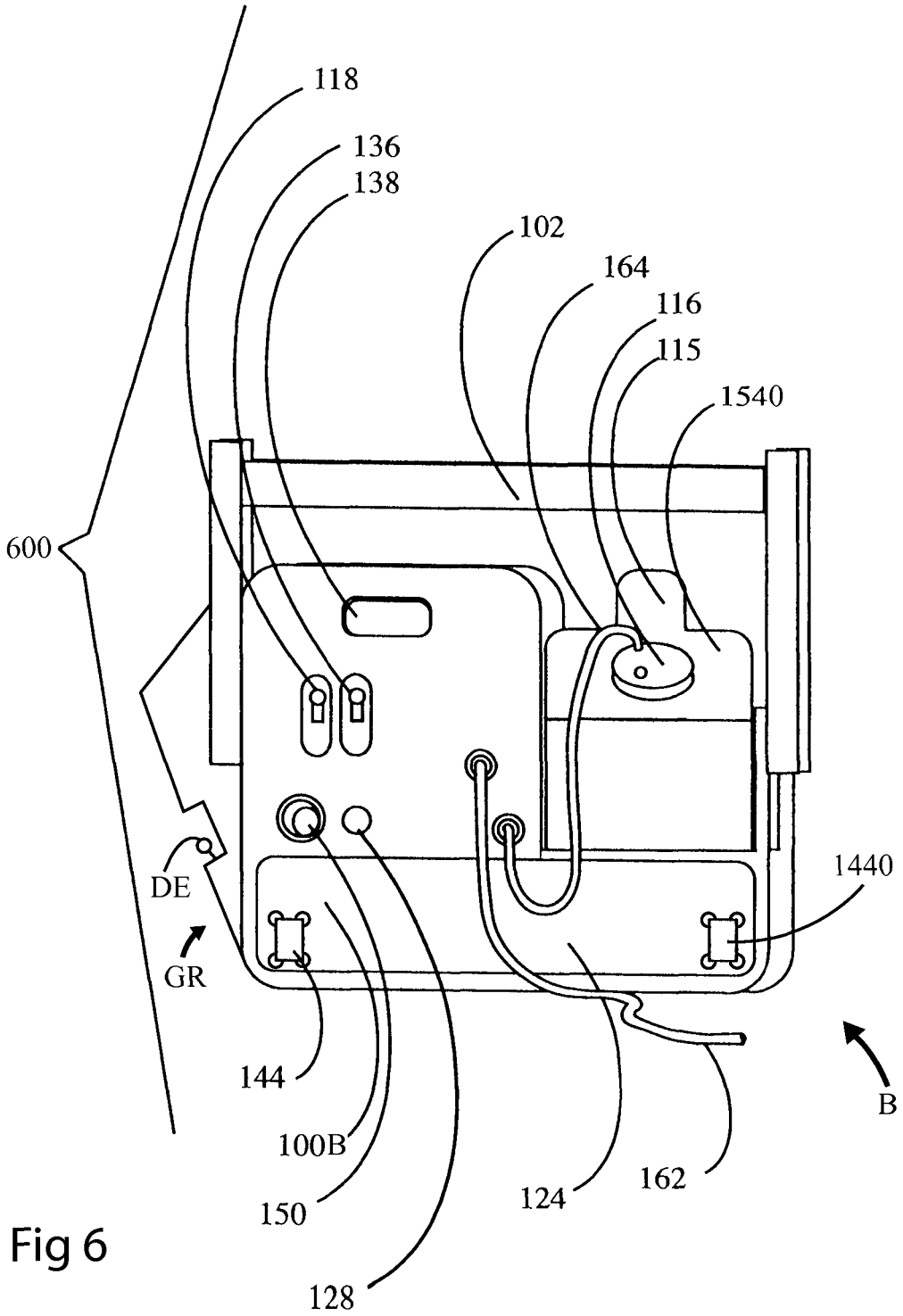
FIG. 6 is a front perspective view of a simplified embodiment.

Referring next to FIG. 6 a basic fuel delivery device 600 is shown with an external fuel cell 1540. The emergency shut off 138 is mounted on the face of the console so no wires are needed to the handle 102. The bottom B of the housing 100B has a groove GR sized to accept the window sill of a vehicle. Tightening clamps 1440 allow the driver to fasten the housing 100B to the window sill. No lower brackets are needed. The clamps 1440 have a distal end DE which clamps against the inside of the window sill. No onboard battery is needed.

Referring next to FIG. 7 the device 105 is shown resting in the engine compartment 107 for troubleshooting. Any of the embodiments of the present invention could be used this way.

Figure 8:
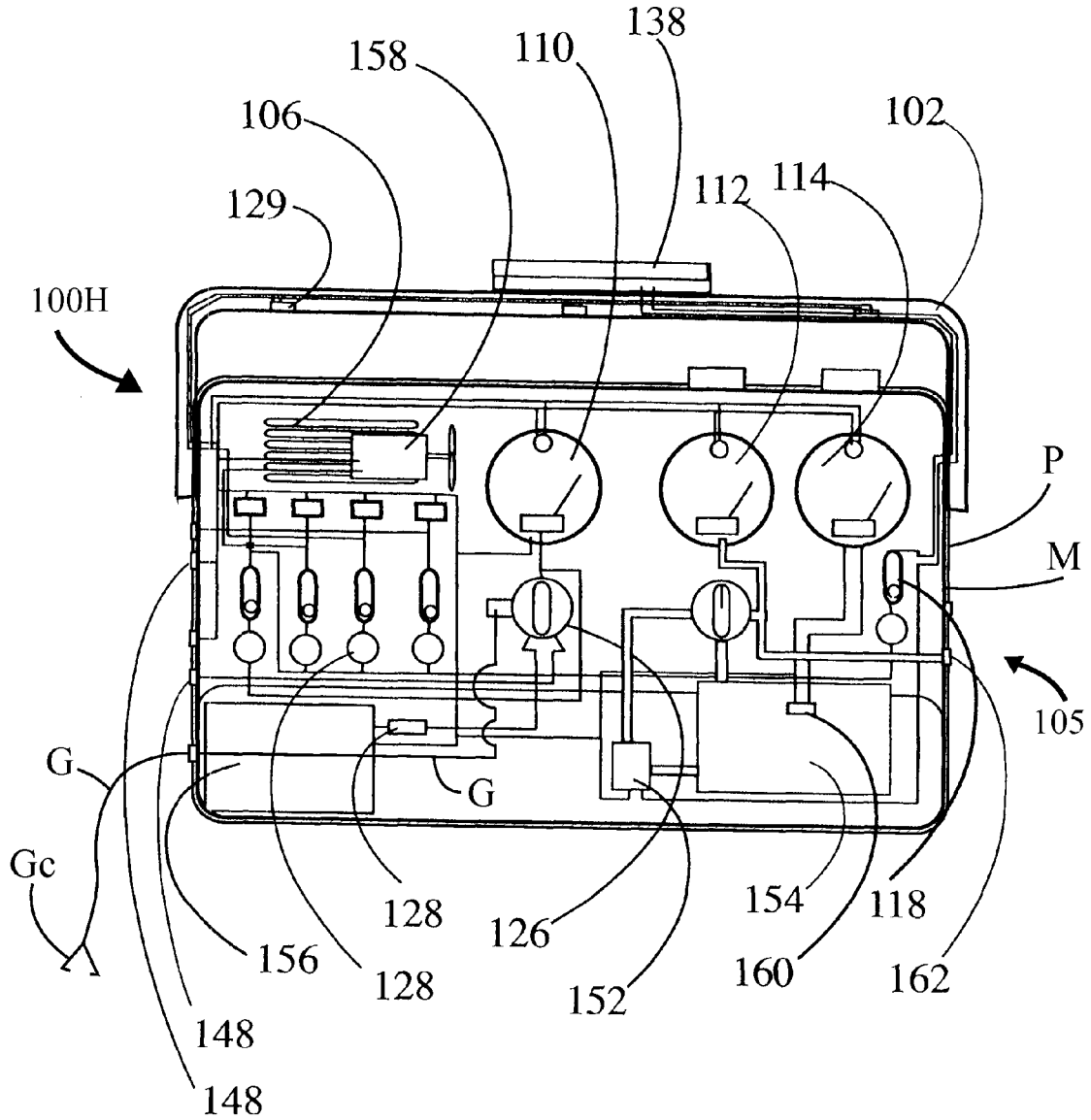
FIG. 8 is the same as FIG. 3 showing a plastic case with a heat resistant (metal) inner shell.

Referring next to FIG. 8 the housing 100H has a special outer plastic shell P and a heat resistant inner shell M. Shell M can be sheet metal to resist engine block heat and shield all components in the housing 100H especially the fuel cell 154 in the event the operator negligently puts the housing 100H in contact with a hot engine block. All embodiments of the present invention can have this style housing 100H.

PARTIAL GLOSSARY OF TERMS

100—Housing
101—Vehicle
102—Carry Handle
103—Vehicle Window
104—Carry Handle Pivot
105—Aux Fuel delivery device
106—Housing Ventilation
107—Vehicle Engine Compartment
108—Indicator Light
110—Power Voltage Indicator
112—Fuel Pressure Gage
114—Fuel Volume Gage
115—Fuel Cell Handle
116—Fuel Cell Container Cap/vent
118—Main Power Switch
120—Main Power Fuse
122—Fuel Pressure Adjustment Knob
124—Storage Compartment
126—Power Source Selector Switch
128—Fuse
129—Console Light on Handle
130—Remote Light Switch
132—Console Lighting Switch
134—Ventilation Fan Switch
136—Fuel Pump Switch
138—Emergency Shut Off

140—Light Source On Tip Of Stand
142—Vehicle Door Cushion
144—Vehicle Temporary Attachment Bracket
146—Hinge
147—Engine Compartment Cushion
148—Remote Power Input Ports
150—External Power Input Ports
152—Fuel Pump
154—Fuel Cell
155—Fuel Cell Vent
156—Onboard Power Supply
158—Fan/Fan Motor
160—Fuel Gage Sender Unit
162—Fuel Delivery Output Line
164—Fuel Transfer Line
P—Plastic Outer Shell
M—Metal Or Heat Resistant Inner Shell Procedure The user of the preferred embodiment 105 begins by ventilation the unit using switch 134. He then evaluates the state of charge within the onboard power supply (156). This is accomplished by enabling the main (118) and emergency (138) power switches supplying power to power indicator gage (110). With confirmation of suitable onboard power, or conclusion that external power will be utilized, user disables power switches, extends temporary attachment brackets 144, drops down hinged and padded mounting braces 142, with pad 147 and installs unit housing 100 on vehicle window 103. User then grounds device with grounding means G,GC and makes ready the chosen source of power intended without enabling any power or emergency switches.

User next familiarizes himself with the fuel supply characteristics of the subject vehicle. The onboard fuel must suit the octane demands of subject engine, and if it is carbureted or fuel injected, possessing Dodge, Chevrolet, Ford or any other type of fittings. User then searches onboard storage compartment 124 which is properly fortified with suitable connection fittings allowing safe attachment of fuel delivery output 162 to subject engine fuel inputs. Confirming tight connections, user then enters vehicle and makes to enable unit.

User enables unit with main power 126 and emergency power switches and using appropriate controls on device 134, 126 supplies fuel to engine. Operator then starts and repositions vehicle as needed. Should operator discover any problems or hazards, emergency fuel supply shut down 138 can be implemented to immediately discontinue fuel delivery. Engine diagnosis can be implemented from the door mounted position or should further diagnosis be required, operator can simply install auxiliary fuel apparatus 105 within engine compartment.

A similar approach would be implemented on other larger or smaller vehicles.

Logically should darkness prevail then the onboard lighting 130, 132 can be enabled, not only illuminating console but environment surrounding unit, be it installed on the vehicle door or engine compartment.

In FIG. 6 not shown is an embodiment without the fuel cell 1540. For fuel a hose connection J on the housing allows a fuel hose to run from the vehicle fuel cap inlet port to a fuel pump inlet connection J on the housing.

In FIG. 3 an optional check valve CV prevents backflow to over-fill the fuel cell 154. All embodiments shown in the present invention could have a check valve.

Equivalent mounting means include mounts to a partially closed driver's window.

All embodiments shown in the present invention could be powered by a cigarette lighter cord attached to the housing. The cigarette lighter male connector could plug into a vehicle cigarette lighter or to an alligator clip adaptor to a battery with the power cord ending in a cigarette lighter female adapter.

Any venting shown could be located at a rear of the housing away from the vehicle.

In summary the main aspect of the present invention is to allow safe operation of a stalled vehicle wherein the hood is down and no apparatus of any kind except a fuel hose is in the engine compartment. A fuel delivery means is mounted adjacent the driver's window so the vehicle can be operated safely to get to the repair bay. In case of emergency an on/off switch right by the driver allows immediate stopping of the fuel flow to the engine.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A portable auxiliary fuel device comprising:
a housing for a fuel cell and a fuel pump;
an electric power inlet for the fuel pump;
said fuel pump being located outside the fuel cell;
an on/off main power switch for the electric power inlet;
a fuse connected in series with the main power switch;
said fuel pump having an inlet form the fuel cell and a fuel delivery output line; and
said housing having a mounting means functioning to secure the housing adjacent a driver's window of a vehicle while the fuel delivery output line is connected to an engine of the vehicle;
said on/off main power switch adjacent the driver's window;
wherein the housing further comprises a heat resistant shell capable of not melting when in contact with a hot engine block;
wherein the fuel cell is mounted fully enclosed inside the housing with a filler cap extending outside the housing;
wherein the housing further comprises an electric exhaust fan and vent;
wherein the mounting means further comprises a pair of hinged lower brackets suited to rest on a vertical door panel and a horizontal L shaped bracket suited to rest on a vehicle windowsill; and
wherein the fuel pump further comprises a pressure regulator with a gauge facing the driver's window.

2. The device of claim 1, wherein the mounting means further comprises a groove on a bottom of the housing to rest on a windowsill of the driver's window.

3. The device of claim 1, further comprising on onboard battery.

4. The device of claim 1, wherein the mounting means further comprises a housing bottom having a groove suited to rest on a vehicle windowsill.

5. The device of claim 1, wherein the housing further comprises a light.

6. The device of claim 1, wherein the housing further comprises a handle with an emergency kill switch.

* * * * *